US006053645A

United States Patent [19]

Myung

[11] Patent Number: 6,053,645

[45] Date of Patent: Apr. 25, 2000

[54] METHOD FOR AUTOMATIC MARGIN CORRECTION ACCORDING TO PAPER FEEDING MODE IN IMAGE FORMATION APPARATUS

[75] Inventor: ho-suck Myung, Anyang-si, Rep. of Korea

[73] Assignee: SamSung Electronics Co., Ltd., Suwon, Rep. of Korea

[21] Appl. No.: 08/997,272

[22] Filed: Dec. 23, 1997

[30] Foreign Application Priority Data

Dec. 23, 1996 [KR] Rep. of Korea ..... 96-70510

[51] Int. Cl.[7] ..... B41J 3/42

[52] U.S. Cl. ..... 400/64; 400/279; 400/283

[58] Field of Search ..... 400/64, 73, 61, 400/62, 76, 279, 283; 101/91; 399/45

[56] References Cited

U.S. PATENT DOCUMENTS

| | | | |
|---|---|---|---|
| 3,803,628 | 4/1974 | Vam Brimer et al. | 346/1 |
| 4,643,089 | 2/1987 | Salazar et al. | 101/91 |
| 4,649,403 | 3/1987 | Miura | 346/160 |
| 4,978,971 | 12/1990 | Goetz et al. . | |
| 4,996,650 | 2/1991 | Kenbo . | |
| 5,249,060 | 9/1993 | Ishikawa et al. . | |
| 5,528,732 | 6/1996 | Klotz, Jr. . | |
| 5,539,863 | 7/1996 | Ueda et al. . | |
| 5,566,278 | 10/1996 | Patel et al. . | |
| 5,592,595 | 1/1997 | Wakabayashi et al. . | |
| 5,604,847 | 2/1997 | Dennis et al. . | |
| 5,638,495 | 6/1997 | Arai . | |
| 5,642,473 | 6/1997 | Klotz, Jr. . | |
| 5,661,550 | 8/1997 | Ko | 399/45 |
| 5,706,409 | 1/1998 | Yeh et al. . | |

*Primary Examiner*—John S. Hilten
*Assistant Examiner*—Charles H. Nolan, Jr.
*Attorney, Agent, or Firm*—Robert E. Bushnell, Esq.

[57] ABSTRACT

In an image formation apparatus receiving image data from a host computer and having an automatic paper-feed mode and a manual paper-feed mode, a method for the automatic correction of the printing margin in the manual paper-feed mode, includes the steps of: storing in a memory of the image formation apparatus a margin differential value corresponding to a difference between printing margins of each mode; selecting one among the automatic and manual modes and generating a signal indicative of the selected mode; and determining whether the generated signal corresponds to the manual paper-feed mode and then correcting the received image data according to the stored margin differential value. Thus, a margin differential existing between automatically fed paper and manually fed paper can be corrected automatically, without separate software manipulation by the user.

22 Claims, 3 Drawing Sheets

METHOD FOR AUTOMATIC MARGIN CORRECTION ACCORDING TO PAPER FEEDING MODE IN IMAGE FORMATION APPARATUS

CLAIM OF PRIORITY

This application makes reference to, incorporates the same herein, and claims all benefits accruing under 35 U.S.C. §119 from my application entitled Method for Changing Margin of Printing Paper According to Paper Feeding Mode in Image Formation Apparatus earlier filed with the Korean Industrial Property Office on Dec. 23, 1996 and there duly assigned Serial No. 96-70510 by that Office.

BACKGROUND OF THE INVENTION

1. Field of the Invention

The present invention relates to an image formation apparatus and, more specifically, to a method for setting automatically the margin of print medium according to a sensed paper feed mode.

2. Discussion of Related Art

In general, an image formation apparatus, such as an ink-jet printer, receives image data generated by a host computer for printing on a sheet of paper fed into the apparatus. To achieve this, paper is fed to a printing position of the image formation apparatus, which generally includes a paper feeding device, as shown in FIG. 1, having automatic and manual paper feed modes.

For the simplified configuration of the paper feeding device, a manual feed guide 12 is installed within a paper loading area 11, on one side thereof and in opposition to an edge guide 13 which is moved laterally according to the width of the paper. The paper loading area 11 coincides with the automatic feeding region. Accordingly, a reference margin differential is generated along one side between the automatic and manual paper-feed modes, which corresponds to the offset position of the manual feed guide 12.

That is, for automatic paper feeding, the reference margin is established with respect to a first guide line A at the side of the loading area 11, thus setting a maximum region L1 for loading paper into the paper feeding device. For manual paper feeding, the manual feed guide 12 is erected, so that the reference margin is shifted inward and established with respect to a second guide line B, thus setting a reduced maximum region L2. A margin differential L3 is therefore created between the automatic feed mode and the manual feed mode, such that L3=L1−L2.

To correct for this differential, a user manipulates the software of the host computer (i.e., the printer driver) to select the manual feed mode thereof. Thus selected, the printing margin is changed according to mode and the host computer generates corrected image data. Therefore, in such an image formation apparatus, the separate and additional operation for manual paper feeding is cumbersome to the user.

SUMMARY OF THE INVENTION

An object of the present invention is to provide a method for automatically setting a reference margin on a sheet of paper fed into an image formation apparatus, by determining whether the paper is being fed automatically or manually and generating corrected (offset) image data when it is determined that the paper is being fed manually fed.

To achieve these and other advantages and in accordance with the purpose of the present invention, as embodied and broadly described, there is provided a method for margin correction in the manual paper-feed mode in an image formation apparatus receiving image data from a host computer and having an automatic paper-feed mode and a manual paper-feed mode. The method comprises the steps of: storing in a memory of the image formation apparatus a margin differential value corresponding to a difference between printing margins of each mode; selecting one among the automatic and manual modes and generating a signal indicative of the selected mode; and determining whether the generated signal corresponds to the manual paper-feed mode and then correcting the received image data according to the stored margin differential value

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENT

Figure 2:
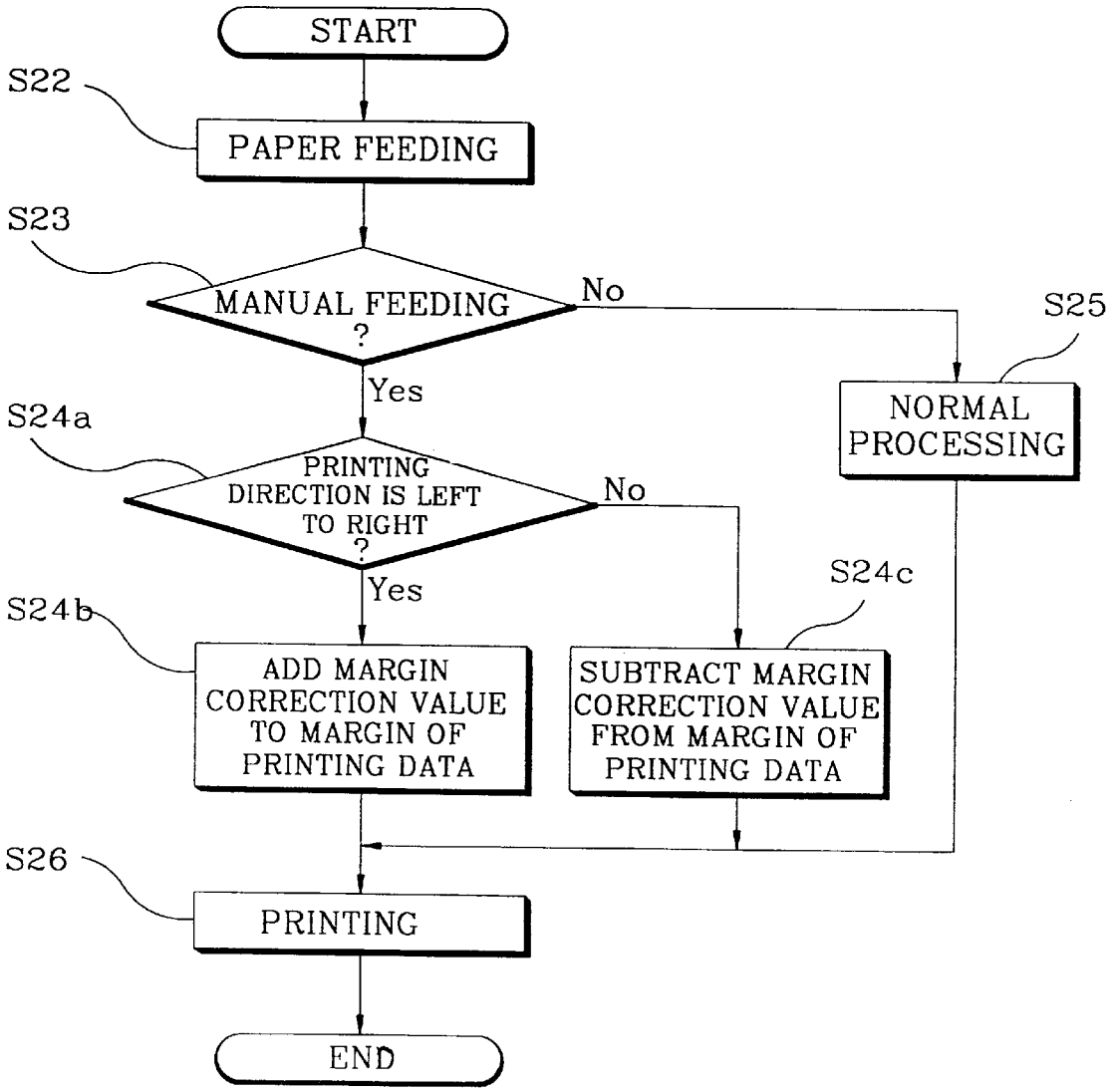
FIG. 2 is a flow diagram according to an embodiment of the present invention, showing a method for automatic margin correction according to the paper feed mode of an image formation apparatus such as an ink-jet printer.

As shown in FIG. 2, the method according to the present invention includes: a step S22 for feeding a sheet of paper into an image formation apparatus; a step S23 for sensing the feeding of the paper; a step S24 for correcting (offsetting) image data generated by a host computer; a step S25 for normally processing the image data; and a step S26 for executing an image formation operation (i.e., printing) The step S24 includes: a sub-step S24*a* for determining the printing direction; a sub-step S24*b* for adding a predetermined margin correction value to the image data; and sub-step S24*c* for subtracting the margin correction value from the image data. The margin correction value corresponds to the margin differential L3.

Figure 1:
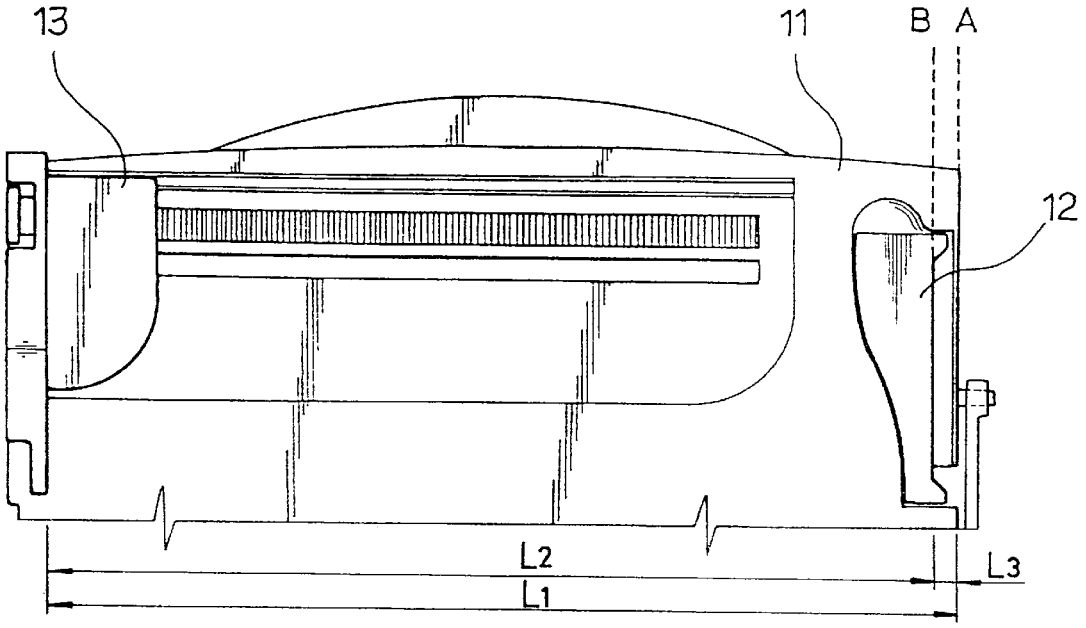
FIG. 1 is a plan view of a typical paper feeding device for use in an image formation apparatus.
Figure 3:
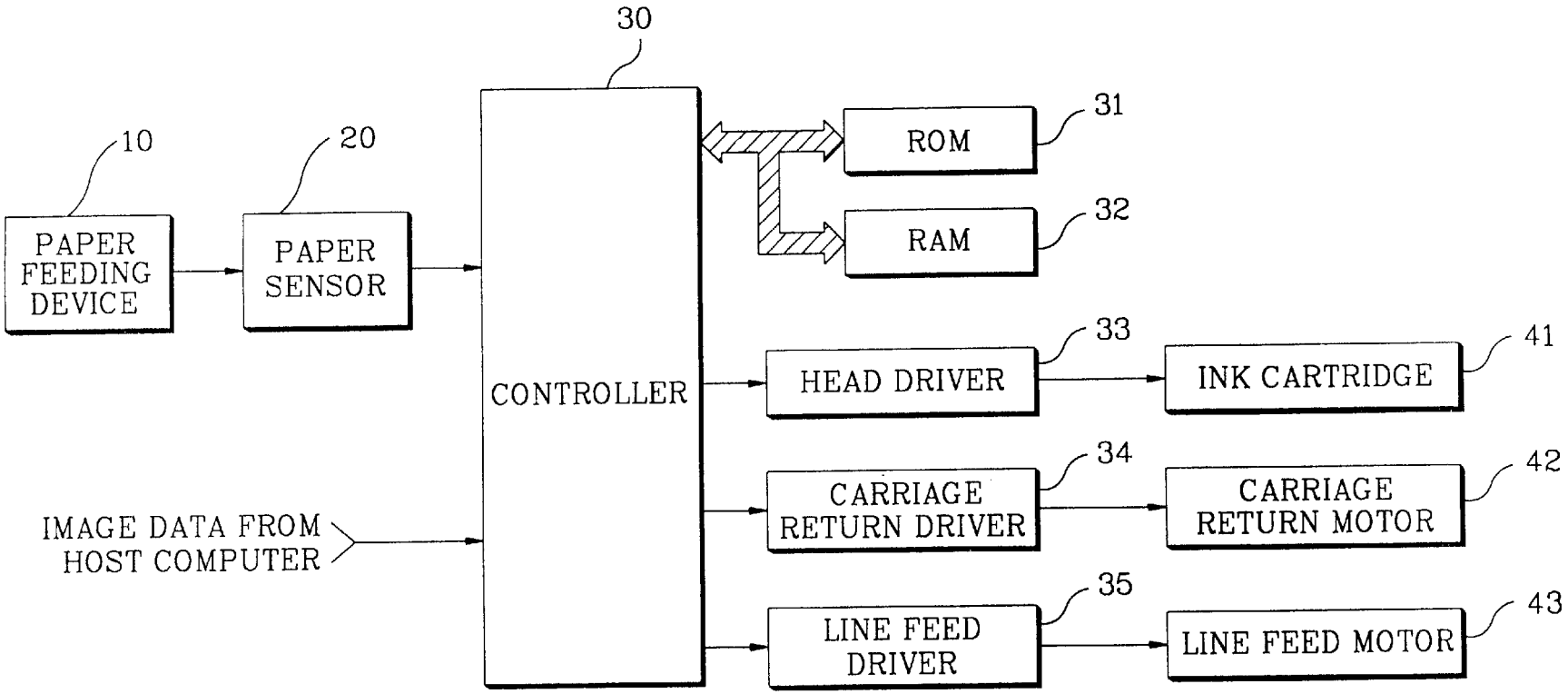
FIG. 3 is a block diagram of an image formation apparatus to which the method of the present invention can be applied.

The above method will now be described in greater detail with reference to FIG. 3. Here, the paper feeding device of FIG. 1 is represented by reference numeral 10.

Sheets of paper are loaded onto the paper loading area 11 of the paper feeding device 10 of an image formation apparatus such as an ink-jet printer, and a user selects the paper feed mode, i.e., automatic or manual (S22). As the paper is fed, a paper sensor 20 installed on the feed path senses the position of the manual feed guide 12, or the mere feeding action (passing) of the paper, and generates a corresponding signal for input to a controller 30. Here, the sensed signal may correspond to the erection of the manual feed guide 12 by, for example, the mechanical activation of a simple switch (not shown), or may correspond to a pulse interval representing the speed at which the paper is being fed. Depending on the sensed signal input, the controller 30 determines whether the paper is being fed in the automatic or manual mode (S23). If the controller 30 determines that the paper is being fed in the automatic mode, the image data is processed normally, i.e., without correcting the margin (S25). On the contrary, if the controller 30 determines that the paper is being fed manually, the image data received from the host computer is changed (S24) to correct the printing margin during image formation, i.e., when printing is carried out (S26).

The margin correction data of the present invention is predetermined and stored in a ROM 31 which also stores a control program for correcting the printing data according to a determination made by the controller 30. In the manual feed mode, the controller 30 writes the stored margin correction data in a RAM 32 and executes the control program, to thereby alter the image data output and control a head driver 33 and carriage return driver 34 accordingly. That is, when the controller 30 executes the control program for correcting the margin, the image data is altered according to the margin correction data (S24*a*, S24*b* and S24*c*).

More specifically, during each printing operation, the controller 30 determines the current printing direction (S24*a*) by detecting whether an ink cartridge 41 moves from left to right, or from right to left, by the operation of a carriage return motor 42. When the ink cartridge 41 is moved from left to right, the control program adds the margin correction data to the image data (S24*b*). Conversely, when the ink cartridge 41 is moved from right to left, the control program subtracts the margin correction data from the image data (S24*c*).

When the margin of the image data thus corrected, the controller 30 controls the operation of a line feed driver 35 and line feed motor 43 and carries out a printing operation using the margin-corrected image data.

The present invention has been described taking as an example an image forming apparatus which feeds sheets of paper automatically or manually with respect to the left side of a paper feeding device. However, the same result can be obtained when the feeding is carried out with respect to any side (i.e., the right, top or bottom) of the paper feeding device. Further, in a line-feed printer such as an ink-jet printer or thermal (e.g., dot-matrix) printer, the lateral movement of a carriage and print head is controlled to carry out printing as described above. However, to perform printing in the case of a laser beam printer, the laser beam is operated according to image data in which the margin has been corrected.

It will be apparent to those skilled in the art that various modifications can be made in the method for automatic margin correction according to the paper feeding mode in an image formation apparatus of the present invention, without departing from the spirit of the invention. Thus, it is intended that the present invention cover such modifications as well as variations thereof, within the scope of the appended claims and their equivalents,

What is claimed is:

1. A method, comprising the steps of:

storing in a memory of an image formation apparatus a margin differential value corresponding to a difference between a default set of margins and an adjusted set of margins, said default set of margins being used to recess images corresponding to print data from edges of a recordable medium transported along a path of conveyance through said apparatus during formation of said images on the recordable medium while said apparatus is in an automatic document feed mode, said adjusted set of margins being used to recess said images from edges of the recordable medium during said formation of said images on the recordable medium while said apparatus is in a manual document feed mode;

introducing the recordable medium into said path of conveyance and forming said images on the recordable medium in said apparatus, said print data being received from an external source;

selecting one mode from among said automatic document feed mode and said manual document feed mode, for transporting the recordable medium through said apparatus;

when said manual document feed mode is selected, correcting margins used to recess said images, automatically without action by an operator, by forming said images on the recordable medium at a location shifted by said margin differential value;

when said automatic document feed mode is selected, not correcting margins used to recess said images, forming said images on the recordable medium at a location not shifted by said margin differential value, utilizing said default set of margins;

said correcting step further comprising the steps of:

determining a direction of motion of a recording unit within said apparatus, for selecting a method of use of said margin differential value;

when said direction of motion of said recording unit is a first direction, forming said images on the recordable medium at a position shifted by an addition of said margin differential value; and when said direction of motion of said recording unit is a second direction opposite to said first direction, forming said images on the recordable medium at a position shifted by a subtraction of said margin differential value.

2. The method of claim 1, further comprising said image formation apparatus being selected from the group consisting of a line-feed printer, an ink jet printer, a dot-matrix printer, a thermal printer, and a laser printer.

3. The method of claim 1, further comprising the step of generating a mode signal corresponding to selection of said manual document feed mode.

4. The method of claim 3, further comprising said mode signal being generated by a switch activated when a manual document feed guide is operated.

5. The method of claim 3, further comprising said mode signal being generated according to a velocity of the recordable medium transported through said apparatus.

6. The method of claim 1, further comprising said step of selecting said one mode from among said automatic document feed mode and said manual document feed mode being performed in response to a velocity of the recordable medium transported through said apparatus.

7. The method of claim 1, further comprising said external source being a host computer.

8. The method of claim 1, further comprising said apparatus being in said manual document feed mode when a manual document feed unit receives the recordable medium manually delivered, and said apparatus being in said automatic document feed mode when an automatic document feed unit receives the recordable medium not manually delivered.

9. The method of claim 1, further comprising said step of selecting said one mode from among said automatic document feed mode and said manual document feed mode being performed in response to a velocity of the recordable medium transported through said apparatus.

10. The method of claim 9, further comprising said apparatus being in said manual document feed mode when a manual document feed unit receives the recordable medium manually delivered, and said apparatus being in said automatic document feed mode when an automatic document feed unit receives the recordable medium not manually delivered.

11. A method, comprising the steps of introducing a recordable medium into an image formation apparatus and forming print data on the recordable medium while the medium is being transported along a path of conveyance through said apparatus, said print data being received from a source separate from said apparatus;

when said apparatus receives the recordable medium manually delivered, correcting margins of said print data, automatically without action by an operator, by forming said print data on the recordable medium at a location shifted by a margin differential value;

when said apparatus receives the recordable medium not manually delivered, not correcting margins of said print data, and forming said print data on the recordable medium at a predetermined default location not shifted by said margin differential value;

said step of correcting said margins of said print data further comprising the steps of:

determining a direction of travel of a recording device within said apparatus, for selecting method of use of said margin differential value;

when said direction of travel of said recording device is a first direction, adding said margin differential value to margins of said print data; and when said direction of travel of said recording device is a second direction opposite to said first direction, subtracting said margin differential value from margins of said print data.

12. The method of claim 11, further comprising said source being a host computer.

13. The method of claim 11, further comprising said image formation apparatus being selected from the group consisting of a line-feed printer, an ink jet printer, a dot-matrix printer, a thennal printer, and a laser printer.

14. An image formation apparatus for correcting margins of print data, comprising:

a manual document feed unit receiving a recordable medium manually delivered;

an automatic document feed unit receiving a recordable medium not manually delivered;

a sensor sensing when said manual document feed unit is utilized and transmitting a corresponding signal;

a controller receiving said signal transmitted from said sensor, determining when said manual document feed unit is utilized, controlling recording of print data on the recordable medium, executing a control program for a correction of margins of said print data when said manual document feed unit is utilized, not executing said control program for said correction of margins of said print data when said manual document feed unit is not utilized, said print data being received from an external source;

a read-only memory storing said control program and storing a margin differential value corresponding to a difference between a default set of margins used to recess images corresponding to said print data from edges of the recordable medium transported along a path of conveyance through said apparatus during formation of said images on the medium while said automatic document feed unit is utilized, and an adjusted set of margins used to recess said images from edges of the recordable medium during said formation while said manual document feed unit is utilized, said margin differential value being for said correction of margins of said print data;

a random access memory storing said margin differential value when said controller determines said manual document feed unit is utilized;

a recording unit recording said print data on the recordable medium according to said controller;

a manual document feed guide unit, for guiding the recordable medium into said apparatus when said manual document feed unit is utilized;

said sensor sensing when said manual document feed unit is utilized by detecting a position of said manual document feed guide unit;

said recording unit further comprising:

a recording head recording said print data on the recordable medium;

a head driver controlling operation of said recording head according to said controller;

a platform supporting said recording head;

a platform driver controlling operation of said platform according to said controller;

a platform return motor transporting said platform across the recordable medium according to said platform driver;

a line feed driver controlling transportation of the recordable medium during recording of the print data according to said controller; and a line feed motor transporting the recordable medium according to said line feed driver.

15. The apparatus of claim 14, further comprising said image formation apparatus being selected from the group consisting of a line-feed printer, an ink jet printer, a dot-matrix printer, a thermal printer, and a laser printer.

16. The apparatus of claim 14, further comprising said sensor sensing when said manual document feed unit is utilized by detecting the speed of the recordable medium transported through said apparatus.

17. The apparatus of claim 14, further comprising said external source corresponding to a host computer.

18. The apparatus of claim 17, further comprising said sensor sensing when said manual document feed unit is utilized by detecting the speed of the recordable medium transported through said apparatus.

19. The apparatus of claim 14, further comprising said sensor sensing when said manual document feed unit is utilized by detecting the speed of the recordable medium transported through said apparatus.

20. The apparatus of claim 19, further comprising said image formation apparatus being selected from the group consisting of a line-feed printer, an ink jet printer a dot-matrix printer a thermal printer, and a laser printer.

21. The apparatus of claim 14, further comprising said controller determining a direction of travel of said recording head for selecting method of use of said margin differential value, adding said margin differential value to margins of said print data when said direction of travel of said recording head is a first direction, and subtracting said margin differential value from margins of said print data when said direction of travel of said recording head is a second direction opposite to said first direction.

22. The apparatus of claim 21, further comprising said sensor sensing when said manual document feed unit is utilized by detecting the speed of the recordable medium transported through said apparatus.

* * * * *